US006649875B2

(12) United States Patent
Haussner et al.

(10) Patent No.: US 6,649,875 B2
(45) Date of Patent: Nov. 18, 2003

(54) SHEATHED-ELEMENT GLOW PLUG AND METHOD FOR ITS PRODUCTION

(75) Inventors: Michael Haussner, Benningen (DE); Helmut Buck, Erdmannhausen (DE); Hans-Peter Kasimirski, Ludwigsburg-Ossweil (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/152,581

(22) Filed: May 23, 2002

(65) Prior Publication Data

US 2002/0190050 A1 Dec. 19, 2002

(30) Foreign Application Priority Data

Jun. 15, 2001 (DE) ..... 101 28 656

(51) Int. Cl.[7] ..... F23Q 7/00
(52) U.S. Cl. ..... 219/270; 123/145 A
(58) Field of Search ..... 219/270; 143/145 A; 29/611

(56) References Cited

U.S. PATENT DOCUMENTS 4,281,451 A * 8/1981 Mann ..... 29/611
4,425,692 A * 1/1984 Minegishi et al. ..... 29/611
4,458,637 A * 7/1984 Minegishi et al. ..... 123/145 A
4,806,734 A * 2/1989 Masaka et al. ..... 219/270
6,064,039 A * 5/2000 Kumada ..... 219/270
2002/0043524 A1 * 4/2002 Taniguchi et al. ..... 219/270
2002/0190049 A1 * 12/2002 Terada ..... 219/270
2002/0195436 A1 * 12/2002 Kumada et al. ..... 219/270
2003/0029855 A1 * 2/2003 Haluschka et al. ..... 219/270

FOREIGN PATENT DOCUMENTS

DE 199 20 758 C1 12/2000

* cited by examiner

*Primary Examiner*—Teresa Walberg
*Assistant Examiner*—Leonid M Fastovsky
(74) *Attorney, Agent, or Firm*—Nixon Peabody LLP; David S. Safran

(57) ABSTRACT

A sheathed-element glow plug including a glow plug body and a heating rod inside the glow plug body, and a heating element. Optionally, the glow plug includes a control element, embedded in insulating material, associated with said heating element which is positioned within the heating rod. The heating element, at the end facing the electrical connection, has an internal pole, with internal pole lead-in, for connection to a power source; while, the end of said heating element facing the combustion chamber is connected to the tip of the heating rod. The glow plug also includes a contact tube which is pushed onto the end region of the heating rod facing the electrical connection in order to extend the heating rod in the direction of the electrical connection to define a hollow space between the contact tube and the internal pole, internal pole lead-in, which is filled with insulating material.

15 Claims, 2 Drawing Sheets

SHEATHED-ELEMENT GLOW PLUG AND METHOD FOR ITS PRODUCTION

BACKGROUND OF THE INVENTION

1. Field of the Invention

The invention relates to a sheathed-element glow plug which includes a glow plug body, a heating rod arranged therein, a heating element and, optionally, a control element associated with said heating element.

2. Description of the Related Art

In multi-polar glow plugs, in particular those plugs in which an ionic current measurement is carried out via the surface of the heating rods, the heating rods must be installed so that they are insulated from the glow plug body. In this situation, glow plugs are known where the glow plug body comprises two separate components, where one component is arranged coaxially in the other and with the components being fixed so as to be electrically insulated from each other by a glass seal formed by melting. With this arrangement, the inner component is used as the outside pole of the heating rod.

However, from a technical point of view it is nearly impossible to fabricate such a structure for smaller glow plugs, and, therefore, production of such smaller glow plugs cannot be undertaken using the normal production methods and devices.

SUMMARY OF THE INVENTION

It is therefore an object of the invention to avoid the disadvantages known in the construction of smaller glow plugs of prior art by providing an improved glow plug construction and a method of producing generic sheathed-element glow plugs of the type described above that can be fabricated using conventional production apparatus for sheathed-element glow plugs. Furthermore, it is an object of the invention to provide smaller glow plugs of a safe contact arrangement, for example, by means of coaxial connectors while at the same time ensuring good mechanical stability of the smaller glow plugs and the contact connections.

DETAILED DESCRIPTION OF THE INVENTION

Figure 1:
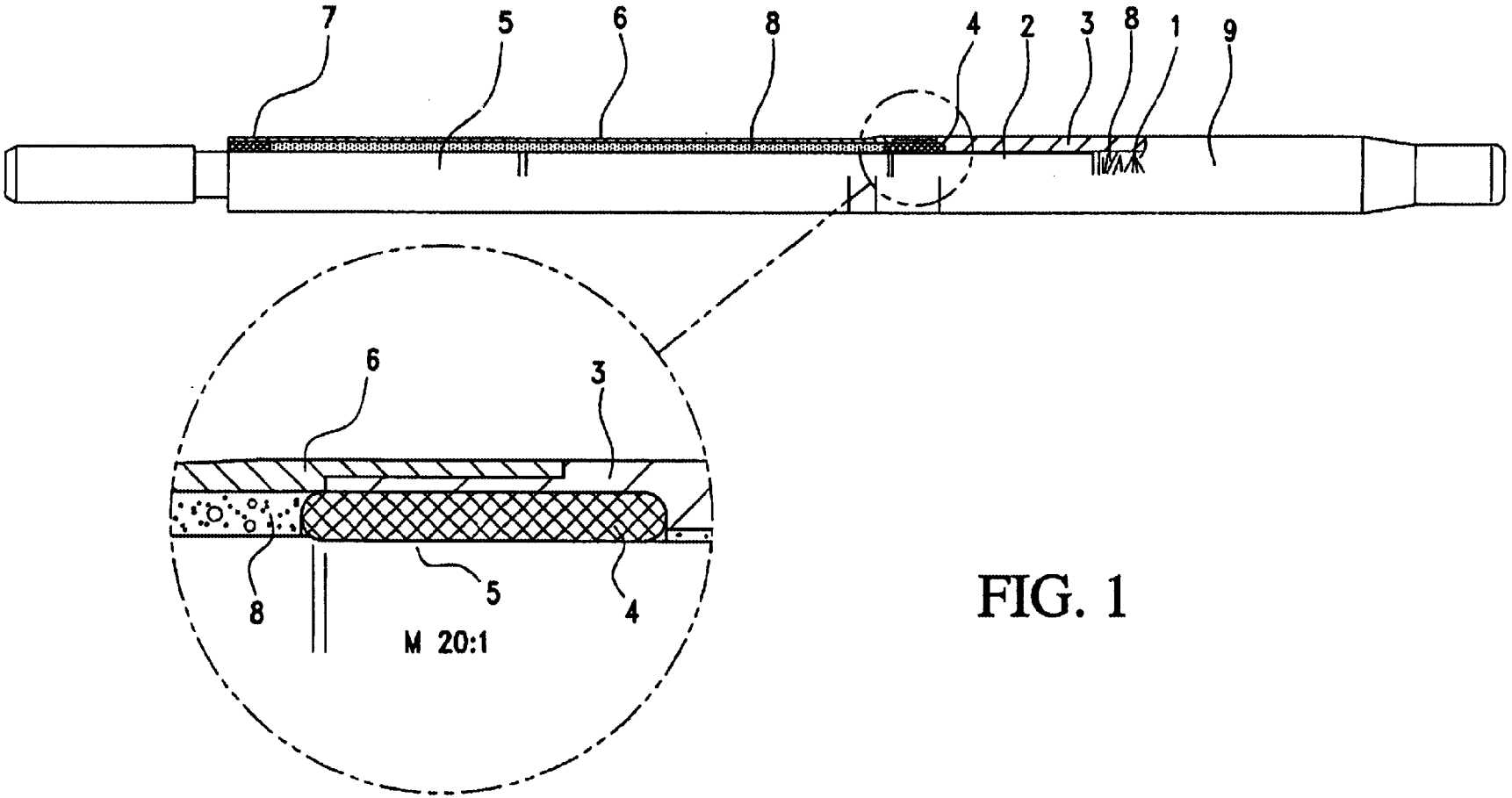
FIG. 1 illustrates, in partial longitudinal section, a heating rod of the invention.

A heating rod 9 of the invention comprises a glow tube 3 in which a heating element 1, preferably in the shape of a heating spiral having a control helix, is embedded in insulating material 8 and insulated from the walls of the glow tube 3. The end of the heating element 1 facing the combustion chamber is connected to the tip of the glow tube 3 so as to establish electrical contact. The end of the heating element 1 facing the electrical connection end of the glow tube is connected to the internal pole 2 which emerges from the heating rod 9 via the pole lead-in 5.

Normally, the length of the glow tube 3 is only approximately one-third to one-half the total length of the sheathed-element glow plug. Further, the end region of the glow tube 3 facing the electrical connection end rests against the internal pole lead-in 5 so that the glow tube is insulated in the end region facing the combustion chamber from the internal pole lead-in 5. This is achieved by placing an insulating O-ring 4 at the juncture between the internal pole lead-in 5 and the glow tube 3 end.

A contact tube 6 is either pushed over the end region of the glow tube 3 facing the connection or is inserted into said glow tube 3, and firmly connected with the end region of the glow tube 3 so as to establish contact, for example by reducing, i.e., swaging, the contact tube 6 onto the glow tube 3. The contact tube 6 leads to the end of the glow plug body or out of said glow plug body, and the contact tube 6 is insulated from the pole lead-in 5, for example, by means of an insulating O-ring 7 which at the same time seals a hollow space between the contact tube 6 and the internal pole lead-in 5. This hollow space is also filled with insulating material 8, e.g., magnesium oxide powder.

By combining the contact tube 6 with the glow tube 3, it is possible to use different wall thicknesses and different materials for said components. For example, a glow tube, made of a high-temperature resistant material such as Inconel® 601 or 6025 UT, having a wall thickness of approximately 1 mm can be used, and a contact tube, made from a material that does not have to be as high-temperature resistant as the material of the glow tube, having a wall thickness of approximately 0.5 mm, can be used.

Figure 2:
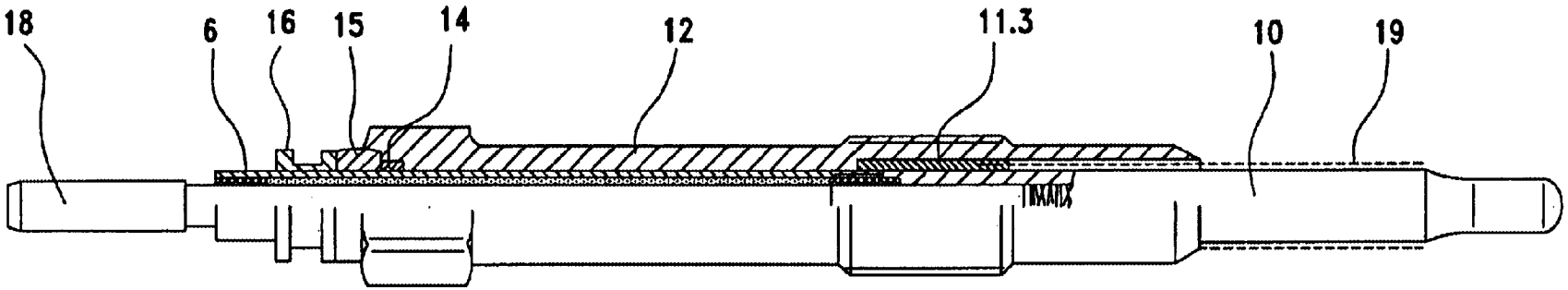
FIG. 2 illustrates, in partial longitudinal section, a preferred embodiment of the glow plug of the invention.

In the invention, the elongated heating rod shown in FIG. 1 forms part of the overall glow plug design illustrated in FIG. 2. In FIG. 2, the glow plug body 12 is arranged so as to be insulated from the heating rod 1. Additionally, in the region facing the combustion chamber, there is provided insulation 11.3, e.g., ceramic material, glass or high-temperature resistant plastic; while, in the region facing the electrical connection, the glow plug body 12 is provided with an insulating seal 14 and an insulating disc 15 in order to be insulated from the contact tube 6.

A connector sleeve 16 is placed in the region of the contact tube 6 which emerges from the connection end region of the glow plug body 12 in order that the connector sleeve 16 can function as a ground connection, such as when constructed for connection to a coaxial connector. Further, on the end facing the connector, the pole lead-in/internal pole is a plus connection.

An insulation layer 19 is provided in areas of the glow tube facing the combustion chamber so that a non-insulated region for ionic current measuring is defined at the tip of the glow plug.

The glow plugs of the invention can be repetitively produced economically using apparatus which are known. Assembly is very easy and at the same time it is possible to maintain very stringent concentricity tolerances.

In a preferred production method, the contact tube 6 is placed onto the glow tube 3 of the heating rod 9, and the hollow space between the contact tube 6 and the inserted internal pole 2 lead-in region 5, having O-ring 4, is filled with insulating material 8, e.g., MgO, and closed off by O-rings 4 and 7. By a known process of swaging on a reducing machine, the MgO insulating material 8, the contact tube 6 and the glow tube 3 are strain hardened to such an extent that an inseparable connection results.

The design of the glow plug according to the present invention ensures an electrically and mechanically stable contact of the connectors; at the same time enables the diameters of the heating rod and the plug body to be of a minimum dimension, thereby, keeping the diameter of the entire glow plug to a minimum.

What is claimed is:

1. A sheathed-element glow plug for use in a combustion chamber comprising:

a glow plug body, and a heating rod positioned in an electrically insulating relationship within the glow plug body, wherein said heating rod has a first electrical connection end and a second tip end, and further includes a heating element embedded in insulating material positioned within the heating rod, wherein said heating element at the first end includes an internal pole having an internal pole lead-in adapted for electrical connection and at the second tip end is connected to the heating rod, and further wherein the heating rod includes a contact tube positioned on the first end of the heating rod and adapted to extend the heating rod in a direction towards electrical connection and adapted to define a hollow space between the contact tube and the heating element which is filled with an insulating material.

2. The sheathed-element glow plug as set forth in claim 1, wherein the contact tube extends to an end of the glow plug body to enable electrical connection.

3. The sheathed-element glow plug as set forth in claim 2, wherein the contact tube is adapted establish a ground connection to a coaxial connector.

4. The sheathed-element glow plug as set forth in claim 1, wherein the glow plug includes a control element associated with said heating element.

5. The sheathed-element glow plug as set forth in claim 1, wherein an insulating element is positioned at the first end of the heating rod between the heating element and the heating rod.

6. The sheathed-element glow plug as set forth in claim 5, wherein the insulating element is an O-ring.

7. The sheathed-element glow plug as set forth in claim 5, wherein a second insulating element is positioned between the contact tube and the heating element at an end of the contact tube which extends in the direction towards electrical connection and closes the hollow space.

8. The sheathed-element glow plug as set forth in claim 7, wherein the second insulating element is an O-ring.

9. The sheathed-element glow plug as set forth in claim 1, wherein the insulating material is magnesium oxide.

10. A method for producing a sheathed-element glow plug comprising:

a glow plug body, and a heating rod positioned in an electrically insulating relationship within the glow plug body, wherein said heating rod has a first electrical connection end and a second tip end, and further includes a heating element embedded in insulating material positioned within the heating rod, wherein said heating element at the first end includes an internal pole having an internal pole lead-in adapted for electrical connection and at the second tip end is connected to the heating rod, and further wherein the heating rod includes a contact tube positioned on the first end of the heating rod and adapted to extend the heating rod in a direction towards electrical connection and adapted to define a hollow space between the contact tube and the heating element which is filled with insulating material, said method comprising the steps of, assembling the contact tube onto the first end of the heating rod to define the hollow space, filling the hollow space with an insulating material, and subjecting the assembled contact tube, heating rod and insulating material to a reduction process for producing a strain-hardened connection of the contact tube and the heating rod.

11. The method for producing a sheathed-element glow plug as set forth in claim 10, further comprising the step of providing an insulating element positioned at the first end of the heating rod between the heating element and the heating rod.

12. The method for producing a sheathed-element glow plug as set forth in claim 11, wherein an O-ring is used as the insulating element in said step of providing an insulating element.

13. The method for producing a sheathed-element glow plug as set forth in claim 11, further comprising the step of providing second insulating element positioned between the contact tube and the heating element at an end of the contact tube which extends in the direction towards electrical connection to close the hollow space.

14. The method for producing a sheathed-element glow plug as set forth in claim 13, wherein an O-ring is used as the second insulating element.

15. The method for producing a sheathed-element glow plug as set forth in claim 10, wherein magnesium oxide is used as the insulating material.

* * * * *